US011129485B2

(12) United States Patent
Jocic

(10) Patent No.: US 11,129,485 B2
(45) Date of Patent: Sep. 28, 2021

(54) ADJUSTABLE DUVET INSERT

(71) Applicant: Sobel Westex, Las Vegas, NV (US)

(72) Inventor: Natalie Jocic, Las Vegas, NV (US)

(73) Assignee: Sobel Westex, Las Vegas, NV (US)

( * ) Notice: Subject to any disclaimer, the term of this patent is extended or adjusted under 35 U.S.C. 154(b) by 53 days.

(21) Appl. No.: 15/682,930

(22) Filed: Aug. 22, 2017

(65) Prior Publication Data

US 2019/0059618 A1 Feb. 28, 2019

(51) Int. Cl.

*A47G 9/08* (2006.01)
*A47G 9/02* (2006.01)
*A47G 9/04* (2006.01)

(52) U.S. Cl.

CPC ..... *A47G 9/0207* (2013.01); *A47G 9/04* (2013.01)

(58) Field of Classification Search

CPC ..... A47G 9/02; A47G 9/0207; A47G 9/0223; A47G 9/023; A47G 9/0284; A47G 9/04; A47G 9/08

See application file for complete search history.

(56) References Cited

U.S. PATENT DOCUMENTS 4,703,528 A * 11/1987 Rolle ..... A47G 9/062 190/2
6,009,579 A * 1/2000 Pedersen ..... A47C 21/022 5/482
2003/0217411 A1* 11/2003 Bradley ..... A47G 9/023 5/486
2009/0044336 A1* 2/2009 Jackson ..... A47G 9/0207 5/486
2009/0070933 A1* 3/2009 Hall ..... A47G 9/02 5/496
2014/0317846 A1* 10/2014 Collins ..... A47G 9/0207 5/486
2018/0213952 A1* 8/2018 Penn ..... A47G 9/064
2018/0317674 A1* 11/2018 Richard ..... A47G 9/0223

* cited by examiner

*Primary Examiner* — Peter M. Cuomo
*Assistant Examiner* — Ifeolu A Adeboyejo
(74) *Attorney, Agent, or Firm* — Howard & Howard Attorneys PLLC

(57) ABSTRACT

A duvet insert includes a plurality of filler compartments for receiving filler material, a first edge including a first number of coupling mechanisms, and a second edge opposing the first edge such that the plurality of filler compartments is positioned between the first edge and the second edge. The second edge includes a second number of coupling mechanisms different than the first number. At least one of the first number of coupling mechanisms or at least one of the second number of coupling mechanisms enables the duvet insert to be coupled to another duvet insert to form a combined duvet insert.

11 Claims, 4 Drawing Sheets

ADJUSTABLE DUVET INSERT

FIELD OF THE DISCLOSURE

The present disclosure relates generally to duvets, and more specifically, to an adjustable duvet insert.

BACKGROUND

The cruise ship industry has a lot of unique challenges that may not be found in other industries. The first is that space is often very constrained within cruise ships. For example, only a limited amount of storage space may be available in cruise ships. Second is that cruise ship passengers often demand certain accommodations that require the cruise ship operators to be flexible. For example, cruise ships often include twin-sized beds to accommodate a variety of sleeping arrangements and a variable number of passengers within each room. Cruise ship passengers often request that larger beds be provided in situations where a single passenger occupies a room or when two passengers want to share a bed. Finally, cruise ships often travel to destinations having very different climates. For example, some cruise ships may travel to tropical destinations where only a minimal amount of bedding is needed, while other cruise ships may travel to colder climates where additional bedding is needed for warmth and comfort.

The present disclosure is aimed at solving one or more of the problems identified above.

SUMMARY

In one embodiment, a duvet insert includes a plurality of filler compartments for receiving filler material, a first edge including a first number of coupling mechanisms, and a second edge opposing the first edge such that the plurality of filler compartments is positioned between the first edge and the second edge. The second edge includes a second number of coupling mechanisms different than the first number. At least one of the first number of coupling mechanisms or at least one of the second number of coupling mechanisms enables the duvet insert to be coupled to another duvet insert to form a combined duvet insert.

BRIEF DESCRIPTION OF THE DRAWINGS

Advantages of the present disclosure will be readily appreciated, as the same becomes better understood by reference to the following detailed description, when considered in connection with the accompanying drawings. Non-limiting and non-exhaustive embodiments of the present disclosure are described with reference to the following figures, wherein like numerals refer to like parts throughout the various views unless otherwise specified.

DETAILED DESCRIPTION

Figure 1:
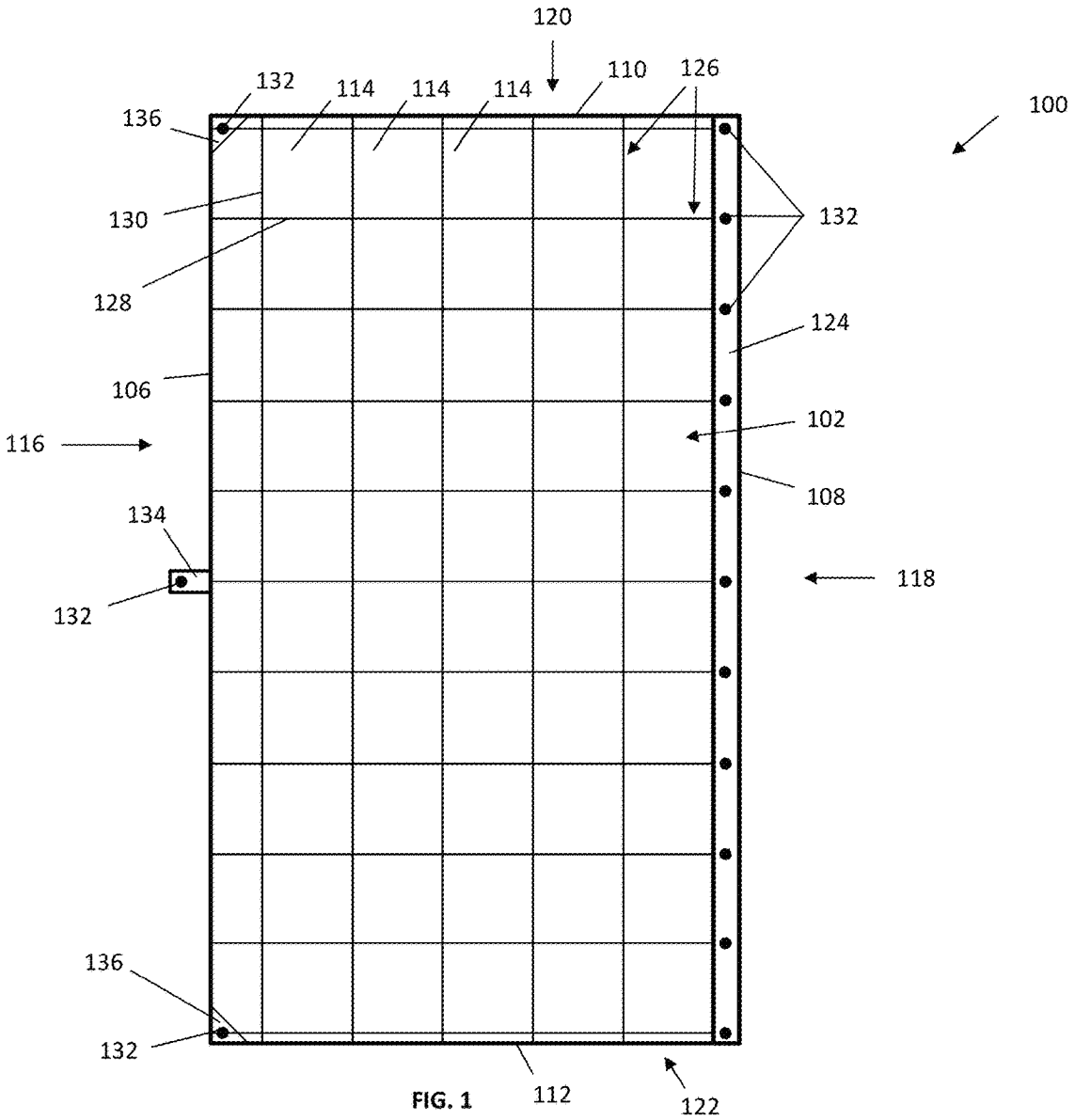
FIG. 1 is a plan view of a duvet insert according to one embodiment.

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Reference throughout this specification to "one embodiment", "an embodiment", "one example" or "an examples" means that a particular feature, structure or characteristic described in connection with the embodiment of example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Several (or different) elements discussed below, and/or claimed, are described as being "coupled", "in communication with" or "configured to be in communication with". This terminology is intended to be non-limiting, and where appropriate, be interpreted to include without limitation, wired and wireless communication using any one or a plurality of suitable protocols, as well as communication methods that are constantly maintained, are made on a periodic basis, and/or made or initiated on an as needed basis.

The present disclosure particularly describes an adjustable duvet insert that can be used in a variety of configurations. The duvet insert includes a plurality of coupling mechanisms, such as snaps or other mechanisms that are coupled to the edges of the duvet insert. For example, a right side of the duvet insert may include a first number of coupling mechanisms coupled to, or formed within, a flange that extends from a top edge to a bottom edge of the duvet insert. A left side of the duvet insert may include a second number of coupling mechanisms coupled to, or formed within, one or more tabs and straps attached to the left side of the duvet insert.

The duvet insert is configured to couple to one or more other duvet inserts to provide flexible bedding options and configurations. For example, in a first configuration, the duvet insert may be used individually to provide an insert for a single bed, such as a twin-sized bed. In a second configuration, two duvet inserts may be coupled together in a side-by-side manner using the coupling mechanisms within each flange of the respective duvet insert. In this configuration, the resulting combined duvet insert can be used to provide bedding for a larger bed, such as a king-sized bed. In a third configuration, two duvet inserts may be coupled together on top of each other to provide additional warmth to users. For example, the coupling mechanisms of the tabs and strap(s) of a first duvet insert may be coupled to the coupling mechanisms of the flange of a second duvet insert positioned on top of the first duvet insert such that a top side of the first duvet insert faces a top side of the second duvet insert. In this configuration, the combined duvet insert can be used to provide bedding having substantially twice the thickness of an individual duvet insert to provide additional warmth to a user.

In a fourth configuration, four duvet inserts may be combined together by effectively combining the second and third configurations together. More specifically, a first and second duvet insert may be coupled together by coupling the flanges together with the respective coupling mechanisms to form a first combined duvet insert. Likewise, a third and fourth duvet insert may be coupled together by coupling their flanges together using respective coupling mechanisms to form a second combined duvet insert. The first combined duvet insert and the second combined duvet insert may be coupled together using the straps and tabs of their constituent duvet inserts. In such a manner, a final combined duvet insert may be formed that can be used to provide bedding for a larger bed, such as a king-sized bed, having substantially twice the thickness of an individual duvet insert. Accordingly, the adjustable duvet insert described herein provides significant flexibility in providing various bedding configurations that are especially useful to space constrained industries such as the cruise ship industry.

FIG. 1 is a plan view illustrating an example duvet insert 100 that may be inserted into a duvet cover (not shown), for example. In the embodiment shown in FIG. 1, the duvet insert 100 includes a top side 102 and a bottom side 104 (shown in FIG. 2). The duvet insert 100 also includes a first edge 106, a second edge 108, a third edge 110, and a fourth edge 112. In the following description, the first edge 106 will be referred to as the left edge, the second edge 108 will be referred to as the right edge, the third edge 110 will be referred to as the top edge, and the fourth edge 112 will be referred to as the bottom edge. However, this is for convenience only. It should be recognized that any of the edges may be switched so that description relating to the right edge may be associated instead with the left edge, etc.

In one embodiment, the duvet insert 100 includes a plurality of filler compartments 114 (sometimes referred to as "boxes") into which filler material may be inserted. The filler compartments 114 are illustrated as squares arranged in a 10×5 grid. As illustrated, each square is 9 inches by 9 inches. Alternatively, any suitable arrangement of filler compartments 114 may be used. In addition, while the filler compartments 114 are illustrated as having a square shape, it should be recognized that any suitable shape may be used. For example, the filler compartments 114 may include rectangles, diamonds, stars, or any other shape or combination of shapes. The filler material is inserted into each filler compartment 114 to increase the duvet insert's ability to retain heat during use. Filler materials may include, without limitation, feathers, down, synthetic fibers (e.g., polyester), wool, or silk, for example.

Each edge of the duvet insert 100 includes a hem portion that is coupled to the filler compartments 114 proximate the respective edge. For example, the left edge 106 includes a left hem portion 116 that is coupled to the filler compartments 114 proximate the left edge 106, the right edge 108 includes a right hem portion 118 that is coupled to the filler compartments 114 proximate the right edge 108, the top edge 110 includes a top hem portion 120 that is coupled to the filler compartments 114 proximate the top edge 110, and the bottom edge 112 includes a bottom hem portion 122 that is coupled to the filler compartments 114 proximate the bottom edge 112. In one embodiment, the right hem portion 118 includes a flange 124 extending from the top edge 110 to the bottom edge 112 of the duvet insert 100.

The duvet insert 100 may be secured together via stitching 126 or another suitable mechanism. For example, each filler compartment 114 may be created by providing stitching 126 that extends from the top side 102 to the bottom side 104 of the duvet insert 100. More specifically, the stitching 126 is provided in a plurality of rows 128 and columns 130 in the duvet insert 100 to form the grid of filler compartments 114. The stitching 126 also forms the hem portions along each edge of the duvet insert 100.

In one embodiment, the duvet insert 100 includes a plurality of coupling mechanisms 132 that enable the duvet insert 100 to be coupled to one or more other duvet inserts. The coupling mechanisms 132 may include snaps that mate with corresponding snaps of another duvet insert 100, for example. In other embodiments, the coupling mechanisms 132 may include hook and loop fasteners, zippers, or any other similar mechanism that enables the respective portions of each duvet insert 100 to be removably coupled to one or more other duvet inserts 100.

In one embodiment, a flange 124 is coupled to the right hem portion to provide a robust and easy to use mechanism to couple and remove the right edge 108 of the duvet insert 100 with respect to a left edge 106 of another duvet insert 100. The flange may be formed of the same material as the duvet insert 100, or may be a different material. For example, the flange 124 may be formed of a suitably durable and tear-resistant fabric or other material to minimize an amount of deformation or tearing of the flange 124 during use of the duvet insert 100. In the example illustrated in FIG. 1, the flange 124 includes a coupling mechanism 132 that is positioned proximate each row 128 of stitching 126. More specifically, each coupling mechanism 132 may be positioned within flange such that a diameter or centerline of each coupling mechanism 132 may be aligned with each row of stitching 126. In such a manner, a structural integrity of the duvet insert 100 may be increased to minimize an amount of tearing or deformation of the duvet insert 100 during use (e.g., when two duvet inserts 100 are attached together via respective flanges and are pulled in different directions by one or more users). For example, if a user pulls one duvet insert 100 away from another duvet insert 100 while the inserts are coupled together, the force will be applied to each insert via the coupling mechanisms 132. When the coupling mechanisms 132 are aligned with the stitching 126, the force will be transferred from the coupling mechanisms 132 to the rows of stitching 126 rather than directly to the filler compartments 114. Since the stitching is more structurally resistant to deformation and tearing than the filler compartments 114, the structural integrity of the duvet insert 100 is increased as compared to alternative arrangements of coupling mechanisms 132.

In an embodiment, the left hem portion 116 includes a plurality of coupling mechanisms 132 positioned with respect to the left edge 106. For example, the coupling mechanisms 132 may be included within one or more straps 134 extending from the left edge 106 of the duvet insert 100 and/or one or more tabs 136 positioned in one or both corners of the left edge 106. As illustrated in FIG. 1, two tabs 136 are positioned in respective corners of the left edge 106, and one strap 134 is coupled to, and extends from, a midpoint of the left edge 106 substantially equidistant from each tab 136. The tabs 136 and the strap 134 each include one coupling mechanism 132 in the illustrated embodiment. Alternatively, any suitable number of tabs 136, straps 134, and/or coupling mechanisms 132 may be provided in the left edge 106 or the left hem portion.

The tabs 136 may include a portion of additional material stitched or otherwise coupled to a respective corner of the left edge 106 of the duvet insert 100. As such, the tab 136 may be a reinforced portion at the intersection of the left edge 106 and the top edge 110, or at the intersection of the left edge 106 and the bottom edge 112 of the duvet insert 100. In one embodiment, each tab 136 may include a portion of material that covers a top of the coupling mechanism 132.

The strap 134 may be formed of the same material as the duvet insert 100, in one embodiment. Alternatively, the strap 134 may be formed of a material that is more durable than the duvet insert material such that the strap 134 may be more resistant to deformation and tearing than the material of the duvet insert 100. As described more fully herein with reference to FIGS. 2-4, the tabs 136 and strap 134 enable the duvet insert 100 to be removably coupled to one or more other duvet inserts 100 in conjunction with the coupling mechanisms 132 of the flange 124.

In the illustrated embodiment, the duvet insert 100 is 50 inches wide with a 2 inch wide flange 124 such that the total width is 52 inches. The duvet insert 100 is 92 inches long. Thus, in the illustrated embodiment, the duvet insert 100 is sized to fit a standard United States twin-sized bed (38 inches wide by 75 inches long) or a standard United States extra-long twin-sized bed (38 inches wide by 80 inches long). It should be recognized that the above dimensions may have a tolerance of plus or minus 1 inch, or another suitable tolerance, in some embodiments. Alternatively, the duvet insert 100 may be sized in any other manner to fit any other suitable bed size and shape.

Figure 2:
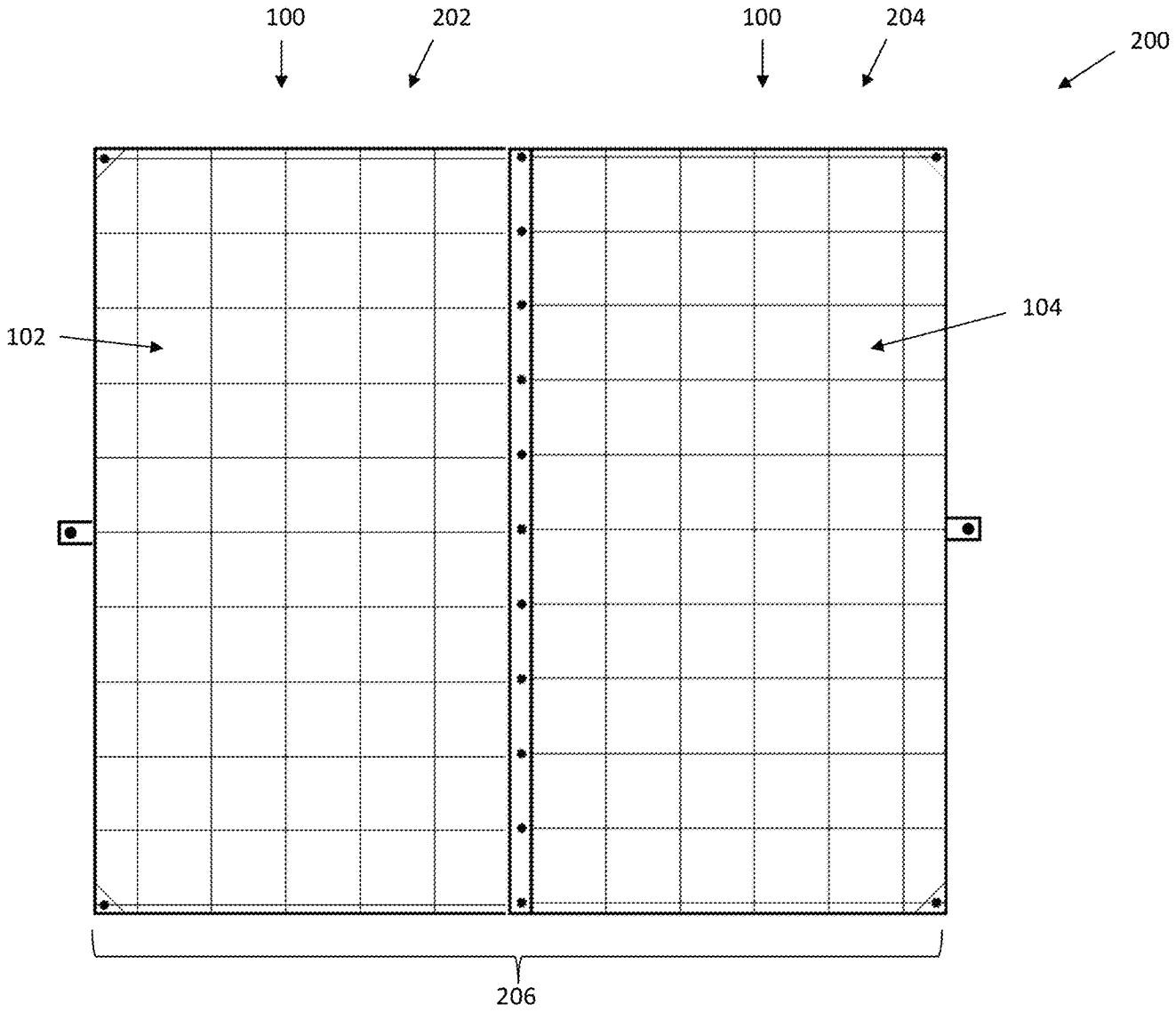
FIG. 2 is a plan view of an adjustable duvet system that includes a plurality of duvet inserts.

FIG. 2 is a plan view of an exemplary adjustable duvet system 200 that includes a plurality of duvet inserts 100, such as a first duvet insert 202 and a second duvet insert 204.

In the example illustrated in FIG. 2, the first duvet insert 202 is positioned with the top side 102 facing upward, while the second duvet insert 204 is turned over such that the bottom side 104 is facing upward. The first duvet insert 202 is coupled to the second duvet insert 204 via a respective flange 124 of each duvet insert. More specifically, each coupling mechanism 132 in the flange of the first duvet insert 202 is coupled to a respective coupling mechanism 132 in the flange of the second duvet insert 204. Thus, in an embodiment in which the coupling mechanisms 132 are snaps, each snap of the first duvet insert flange 124 is snapped onto a respective snap of the second duvet insert flange 124. In this embodiment, the tabs 136 and straps 134 may not be used for coupling the first duvet insert 202 and the second duvet insert 204 together.

In the illustrated embodiment, the coupling of the first duvet insert 202 to the second duvet insert 204 creates a combined duvet insert 206 that fits a substantially larger bed size. In a specific embodiment in which the first duvet insert 202 and the second duvet insert 204 are each sized to fit a standard twin-sized bed, the combined duvet insert 206 is sized to fit a standard king-size bed.

In the illustrated embodiment, the combined duvet insert 206 is 102 inches wide and is 92 inches long. Thus, in the illustrated embodiment, the combined duvet insert 206 is sized to fit a standard United States king-sized bed (76 inches wide by 80 inches long). It should be recognized that the above dimensions may have a tolerance of plus or minus 1 inch, or another suitable tolerance, in some embodiments. Alternatively, the combined duvet insert 206 may be sized in any other manner to fit any other suitable bed size and shape.

Accordingly, the adjustable duvet system 200 described herein provides significant flexibility to bedding providers, such as cruise ship operators, in meeting differing customer demands and bedding arrangements. For example, a cruise ship operator may only need to stock a large number of single duvet inserts 100, and may combine the single twin-sized duvet inserts 100 to create a combined king-sized duvet insert 206 on an as-needed basis. Thus, the cruise ship operator may not need to dedicate storage to larger king-sized duvet inserts that may or may not be used on an individual cruise.

In addition, the combined duvet insert 206 may be easily separated into the individual duvet inserts (the first duvet insert 202 and the second duvet insert 204) by merely disengaging the coupling mechanisms 132 of each flange, such as by un-snapping the snaps. The individual duvet inserts 100 may also be laundered more easily and efficiently than a larger king-sized duvet insert since a single duvet insert may be placed into a smaller laundry machine, or may be fit into a pre-existing load of laundry that may not have space for a king-sized duvet insert.

While the foregoing descriptions have discussed two standard twin-sized duvet inserts being combined to form a standard king-sized duvet insert, it should be recognized that any suitable sized duvet inserts may be combined together to form any suitable sized single or combined duvet insert as desired.

Figure 3:
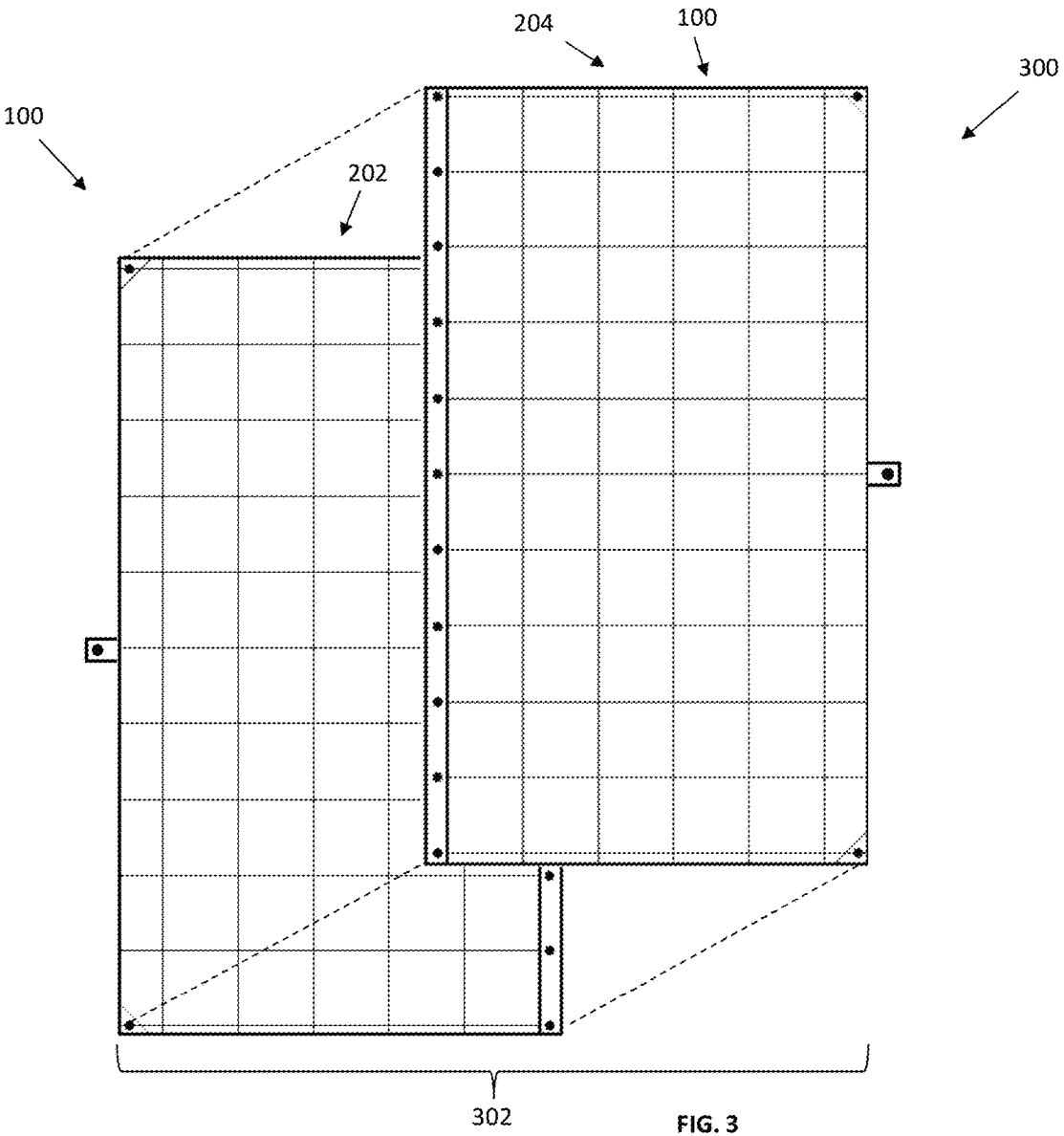
FIG. 3 is a plan view of another adjustable duvet system that includes a plurality of duvet inserts.

FIG. 3 is a plan view of an exemplary adjustable duvet system 300 that includes a plurality of duvet inserts 100, such as a first duvet insert 202 and a second duvet insert 204.

In the example illustrated in FIG. 3, the first duvet insert 202 is positioned with the top side 102 facing upward, while the second duvet insert 204 is turned over such that the bottom side 104 is facing upward. The second duvet insert 204 is placed on top of the first duvet insert 202 to form a combined duvet insert 302 having substantially twice the thickness of a single duvet insert 100. The first duvet insert 202 is coupled to the second duvet insert 204 via the coupling mechanisms 132 of each duvet insert. More specifically, the coupling mechanisms 132 of the tabs 136 and strap 134 of the first duvet insert 202 are coupled to respective coupling mechanisms 132 of the flange 124 of the second duvet insert 204. Likewise, the coupling mechanisms 132 of the tabs 136 and strap 134 of the second duvet insert 204 are coupled to respective coupling mechanisms 132 of the flange 124 of the first duvet insert 202.

In the illustrated embodiment, the coupling of the first duvet insert 202 to the second duvet insert 204 creates a combined duvet insert 302 that fits the same bed size as an individual duvet insert, but that provides additional warmth as compared to a single duvet insert.

Accordingly, the adjustable duvet system 300 described herein provides further flexibility to bedding providers, such as cruise ship operators, in meeting differing customer demands and bedding arrangements. For example, a cruise ship operator may sail to both warm weather destinations and cold weather destinations. During a cruise to a warm weather destination, the cruise ship operator may use the duvet inserts individually since passengers may not require much warmth to be provided. Conversely, during a cruise to a cold weather destination, the cruise ship operator may couple two duvet inserts 100 together to form the combined duvet insert 302 to provide passengers with warmer bedding. In a similar manner as described above with reference to FIG. 2, the cruise ship operator may only need to stock a large number of single duvet inserts 100, and may combine the single duvet inserts 100 to create a thicker, combined duvet insert 302 on an as-needed basis. Thus, the cruise ship operator may not need to dedicate storage to duvet inserts having differing thicknesses that may or may not be used on an individual cruise.

In addition, the combined duvet insert 302 may be easily separated into the individual duvet inserts by merely disengaging the coupling mechanisms 132 of each flange, as described above with reference to FIG. 2. The individual duvet inserts 100 may also be laundered more easily and efficiently than a duvet insert having a larger thickness since a single duvet insert 100 may be placed into a smaller laundry machine, or may be fit into a pre-existing load of laundry that may not have space for a thicker duvet insert.

While the foregoing descriptions have discussed two standard twin-sized duvet inserts being combined to form a standard king-sized duvet insert, it should be recognized that any suitable sized duvet inserts may be combined together to form any suitable sized single or combined duvet insert as desired.

Figure 4:
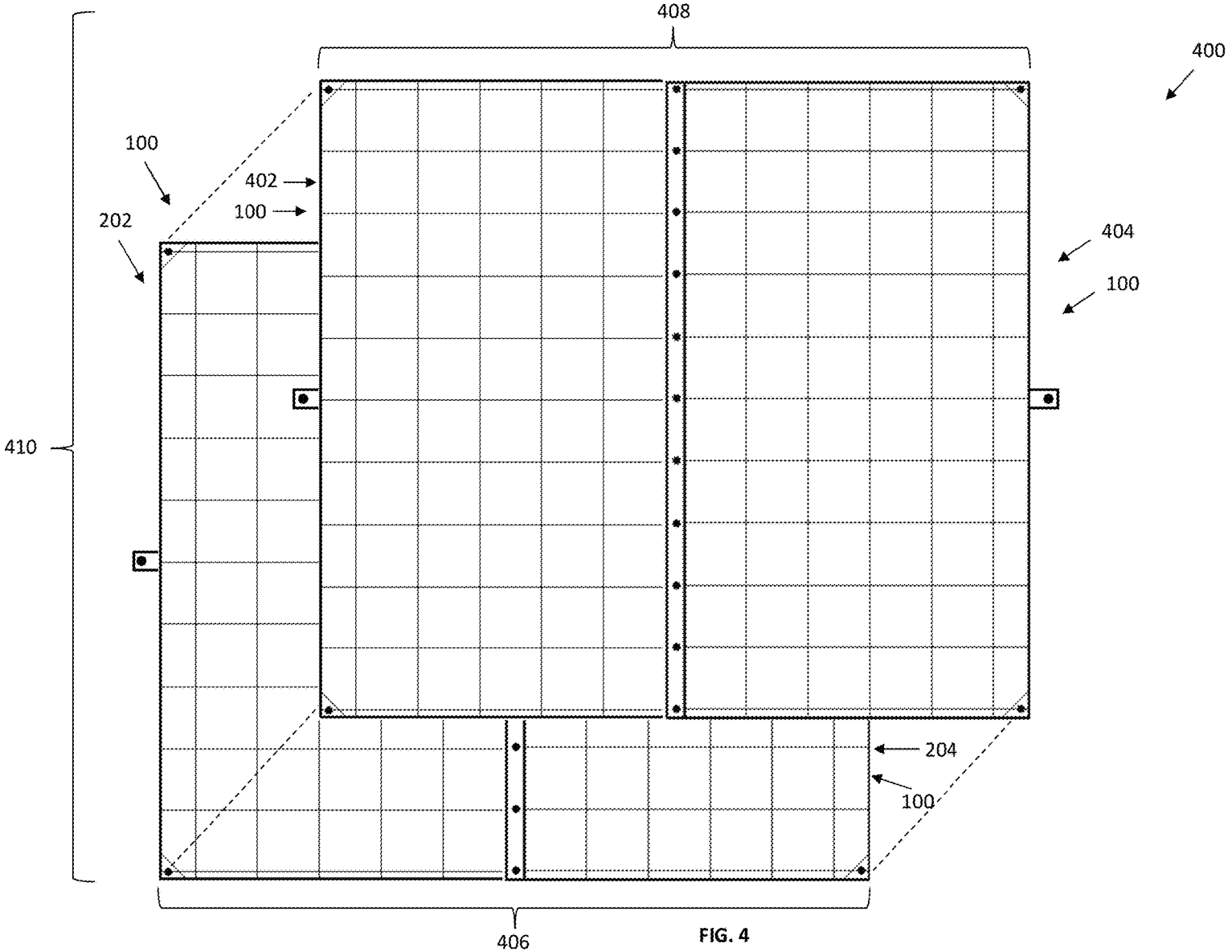
FIG. 4 is a plan view of another adjustable duvet system that includes a plurality of duvet inserts.

FIG. 4 is a plan view of an exemplary adjustable duvet system 400 that includes a plurality of duvet inserts 100, such as a first duvet insert 202, a second duvet insert 204, a third duvet insert 402, and a fourth duvet insert 404.

In the example illustrated in FIG. 4, the first duvet insert 202 is coupled to the second duvet insert 204 to form a first combined duvet insert 406, and the third duvet insert 402 is coupled to the fourth duvet insert 404 to form a second combined duvet insert 408. The first combined duvet insert 406 is then coupled to the second combined duvet insert 408 to form a final combined duvet insert 410 as described more fully herein.

Specifically, to form the first combined duvet insert 406, the first duvet insert 202 is positioned with the top side 102 facing upward, while the second duvet insert 204 is turned over such that the bottom side 104 is facing upward. The first duvet insert 202 is coupled to the second duvet insert 204 via a respective flange 124 of each duvet insert. More specifically, each coupling mechanism 132 in the flange of the first duvet insert 202 is coupled to a respective coupling mechanism 132 in the flange of the second duvet insert 204.

In the illustrated embodiment, the coupling of the first duvet insert 202 to the second duvet insert 204 creates a first combined duvet insert 406 that fits a substantially larger bed size. In a specific embodiment in which the first duvet insert 202 and the second duvet insert 204 are each sized to fit a standard twin-sized bed, the first combined duvet insert 406 is sized to fit a standard king-size bed.

To form the second combined duvet insert 408, the third duvet insert 402 is positioned with the top side 102 facing upward, while the fourth duvet insert 404 is turned over such that the bottom side 104 is facing upward. The third duvet insert 402 is coupled to the fourth duvet insert 404 via a respective flange 124 of each duvet insert in a similar manner as the first duvet insert 202 and the second duvet insert 204. More specifically, each coupling mechanism 132 in the flange of the third duvet insert 402 is coupled to a respective coupling mechanism 132 in the flange of the fourth duvet insert 404. In the illustrated embodiment, the coupling of the third duvet insert 402 to the fourth duvet insert 404 creates a second combined duvet insert 408 that fits a substantially larger bed size similar to the first combined duvet insert 406.

The second combined duvet insert 408 is then placed on top of the first combined duvet insert 406 to form a final combined duvet insert 410 having substantially twice the thickness of a single duvet insert 100. The first combined duvet insert 406 is coupled to the second combined duvet insert 408 via the tabs 136 and straps 134 of each duvet insert. More specifically, the coupling mechanisms 132 of the tabs 136 and strap 134 of the first combined duvet insert 406 (i.e., of the combination of the first duvet insert 202 and the second duvet insert 204) are coupled to respective coupling mechanisms 132 of the tabs 136 and strap 134 of the second combined duvet insert 408 (i.e., of the combination of the third duvet insert 402 and the fourth duvet insert 404).

In the illustrated embodiment, the coupling of the first combined duvet insert 406 to the second combined duvet insert 408 creates a final combined duvet insert 410 that fits the same bed size as the first combined duvet insert 406 and the second combined duvet insert 408, but that provides additional warmth as compared to the individual duvet inserts.

Accordingly, the final combined duvet insert 410 described with respect to FIG. 4 combines the benefits of the embodiments described with respect to FIGS. 2 and 3. For example, the final combined duvet insert 410 may be used as bedding for a larger, king-size bed, and may also be used to provide additional warmth for passengers who desire it or for cruises to colder climates.

Although specific features of various embodiments of the disclosure may be shown in some drawings and not in others, this is for convenience only. In accordance with the principles of the disclosure, any feature of a drawing or other embodiment may be referenced and/or claimed in combination with any feature of any other drawing or embodiment.

This written description uses examples to describe embodiments of the disclosure and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A combined duvet insert, comprising:

a first duvet insert having first and second sides; and, a second duvet insert having first and second sides, wherein each duvet insert includes:

a plurality of filler compartments for receiving filler material;

first, second, third and fourth edges; and, a flange coupled to the second edge, wherein the first, third and fourth edges and the flange define an outer perimeter of the duvet insert;

first and second tabs positioned at first and second corners of the duvet insert, respectively, adjacent the first edge and located within the outer perimeter of the duvet insert, each tab composed of an additional piece of material coupled to the duvet insert; and, a strap fixedly attached to, and being positioned on, the first edge at a midpoint substantially equidistant between the first corner and the second corner and being extendable in a direction away from the duvet insert and outside of the outer perimeter of the duvet insert;

a first coupling mechanism affixed to the first tab on the first side of the duvet insert, a second coupling mechanism affixed to the second tab on the first side of the duvet insert, and a third coupling mechanism positioned on the strap, wherein the second edge opposes the first edge such that the plurality of filler compartments is positioned in a plurality of rows between the first edge and the second edge, the plurality of rows being defined by stitching in the respective duvet insert, wherein each duvet insert further includes a plurality of flange coupling mechanisms affixed to the flange on the first side of the duvet inset, each flange coupling mechanism being aligned with a respective stitching of one of the plurality of rows, wherein the first and second duvet inserts are configured in one of an extended configuration and a doubled configuration, wherein in the extended configuration the second duvet insert is arranged relative to the first duvet insert such that:

(1) the first side of the first duvet faces the first side of the second duvet insert, and (2) the flange coupling mechanisms of the first duvet insert is are removably coupled to the flange coupling mechanisms of the second duvet insert such that: (a) the flange of the second duvet is retained in a position that overlaps with the flange of the first duvet insert along the entire second edge of the first and second duvet inserts and (b) the combined duvet insert has an outer perimeter greater than the outer perimeters of the first and second duvet inserts, wherein in the doubled configuration:

(1) the first side of the first duvet faces the first side of the second duvet insert, (2) the first coupling mechanism affixed to the first tab on the first side of the first duvet insert is removably coupled to a first one of the flange coupling mechanisms of the second duvet insert, the first one of the flange coupling mechanisms of the second duvet insert being located at a first end of the flange of the second duvet insert, (3) the second coupling mechanism affixed to the second tab on the first side of the first duvet insert is removably coupled to a second one of the flange coupling mechanisms of the second duvet insert, the second one of the flange coupling mechanisms of the second duvet insert being located at a second end of the flange of the second duvet insert, (4) the third coupling mechanism on the strap of the first duvet is removably coupled to a third one of the flange coupling mechanisms of the second duvet insert, the third one of the flange coupling mechanisms of the second duvet insert being located at a point between the first and second end of the flange of the second duvet insert, (5) the first coupling mechanism affixed to the first tab on the first side of the second duvet insert is removably coupled to a first one of the flange coupling mechanisms of the first duvet insert, the first one of the flange coupling mechanisms of the first duvet insert being located at a first end of the flange of the first duvet insert, (6) the second coupling mechanism affixed to the second tab on the first side of the second duvet insert is removably coupled to a second one of the flange coupling mechanisms of the first duvet insert, the second one of the flange coupling mechanisms of the first duvet insert being located at a second end of the flange of the first duvet insert, (7) the third coupling mechanism on the strap of the second duvet is removably coupled to a third one of the flange coupling mechanisms of the first duvet insert, the third one of the flange coupling mechanisms of the first duvet insert being located at a point between the first and second end of the flange of the first duvet insert, such that, in the doubled configuration the combined duvet insert has an outer perimeter equal to the outer perimeters of the first and second duvet inserts.

2. The combined duvet insert of claim 1, further comprising a third duvet insert, and a fourth duvet insert coupled together.

3. The combined duvet insert of claim 2, wherein the first duvet insert and the second duvet insert are coupled together to form a first combined duvet insert, and the third duvet insert and the fourth duvet insert are coupled together to form a second combined duvet insert.

4. The combined duvet insert of claim 1, wherein each coupling mechanism is a snap fastener.

5. The combined duvet insert of claim 1, wherein each coupling mechanism is a hook and loop fastener.

6. The combined duvet insert of claim 1, wherein the flange and the duvet insert comprise the same material.

7. The combined duvet insert of claim 1, wherein the flange and the duvet insert each comprise a different material.

8. The combined duvet insert of claim 7, wherein the material of the flange comprises a tear-resistant fabric.

9. The combined duvet insert of claim 1, wherein the plurality of filler compartments comprise rectangular shapes.

10. The combined duvet insert of claim 1, wherein the plurality of filler compartments comprise diamond shapes.

11. The combined duvet insert of claim 1, wherein the plurality of filler compartments comprise star shapes.

* * * * *